United States Patent [19]

Theiler

[11] 4,455,059

[45] Jun. 19, 1984

[54] TERMINAL CAP FOR ACCOMMODATING TERMINAL POSTS

[75] Inventor: Werner C. Theiler, Dix Hills, N.Y.

[73] Assignee: American Eyelet Co., Inc., Bayshore, N.Y.

[21] Appl. No.: 329,612

[22] Filed: Dec. 10, 1981

[51] Int. Cl.[3] ..... H01R 11/26

[52] U.S. Cl. ..... 339/224

[58] Field of Search ..... 339/224, 225, 238, 275

[56] References Cited

U.S. PATENT DOCUMENTS

| | | | |
|---|---|---|---|
| 1,869,524 | 8/1932 | Taylor | 339/232 |
| 2,793,350 | 5/1957 | Anderson | 339/224 |
| 2,844,806 | 7/1958 | McKissick | 339/116 R |
| 4,118,097 | 10/1978 | Budnick | 339/232 |

FOREIGN PATENT DOCUMENTS

| | | | |
|---|---|---|---|
| 1403228 | 8/1975 | United Kingdom | 339/224 |
| 2038569 | 7/1980 | United Kingdom | 339/224 |

*Primary Examiner*—Joseph H. McGlynn
*Assistant Examiner*—Paula Austin
*Attorney, Agent, or Firm*—Robert K. Youtie

[57] ABSTRACT

A battery post terminal including a connector cap having a generally cylindrical outer sleeve portion, an inner sleeve portion flaring longitudinally inwardly from the inner end of the outer sleeve portion for frictional engagement with a battery terminal post, a lip outstanding from the larger end of the inner sleeve portion, and a cable connector extending generally radially from the lip.

9 Claims, 6 Drawing Figures

25
27
2
11
26
28
21
16
10
17
15
18
20
2
12

25
30
11
26
28
16
15
12
20

30a
11a
28a
15a 30b
11b
26b

28b 25d
41
42
40
26d
30d
43
11d
45
28d
12d
20d
12d
20d
15d 11c
25c
26c
17c
12c 28c
20c
35
35
36
37
15c

TERMINAL CAP FOR ACCOMMODATING TERMINAL POSTS

BACKGROUND OF THE INVENTION

As is well known to those versed in the electrical connector arts, battery post connectors in the past have generally required massive proportions beyond that essential for strength or conductivity, such proportions resulting in excessive costs, weight, embrittlement, and the like.

Examples of the prior art of which applicant is aware are as follows:

| U.S. PAT. NO. | PATENTEE |
|---|---|
| 1,854,328 | Binder |
| 1,869,524 | Taylor |
| 1,951,259 | Ryalls |
| 2,384,211 | Sutherland |
| 2,675,532 | Quick |
| 2,729,802 | Jordan et al. |
| 2,844,806 | McKissick |

The instant application is concerned with improvements over the battery post terminals disclosed in copending patent applications of Angelo J. Paolino, Ser. No. 238,059 filed Mar. 2, 1981 and Ser. No. 297,224 filed Aug. 28, 1981, which copending applications have the same assignee as the instant application.

SUMMARY OF THE INVENTION

It is an important object of the present invention to provide a battery post terminal construction, and particularly a sheet metal cap for a battery post terminal which is extremely simple and inexpensive to manufacture, capable of quick and easy multiple tap-off's adapted for quick and easy, but highly effective frictional engagement on and removal from the battery terminal posts, as well as positive connection thereto, if desired.

It is still a further object of the present invention to provide a connector cap for a battery terminal which effects savings in materials, provides enhanced frictional retention on terminal posts within the wide range of commercial tolerances, simplifies connection to the cap of plural cable lugs, and which is staunch and reliable throughout a long useful life.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENTS

Figure 1:
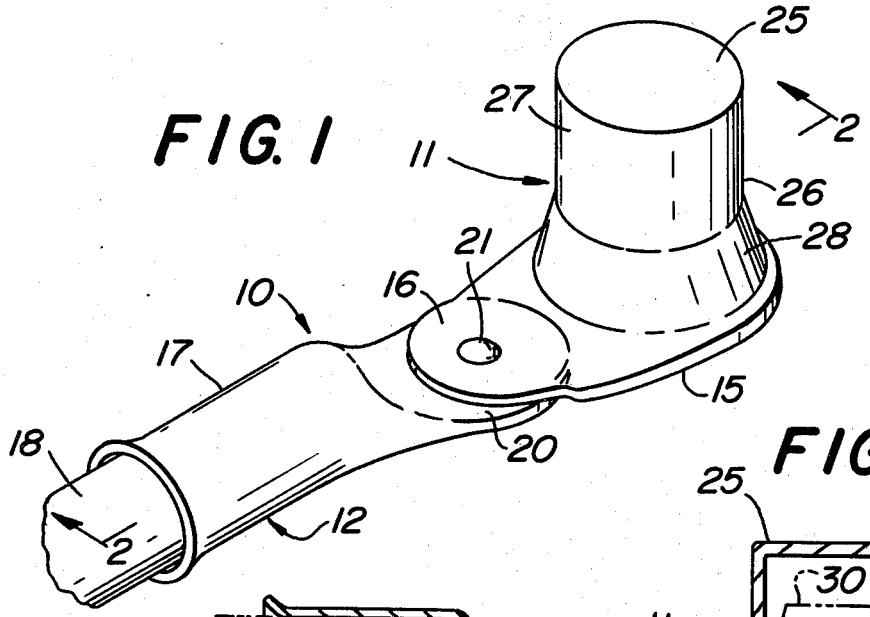
FIG. 1 is a top perspective view showing a battery terminal construction for connection to a terminal post, which illustrates features of the instant invention.

Referring now more particularly to the drawings, and specifically to FIG. 1 thereof, a battery terminal construction is illustrated therein and generally designated 10. The terminal 10 may be substantially completely fabricated of ductile conductive material, such as copper or the like, and may include a connector cap 11 and cable connector or barrel 12 extending from the cap.

More specifically, the cap 11 may be an inverted cup, cover or shell, say drawn or otherwise suitably formed of sheet copper and having a brim, lip or flange 15, provided with a radial extension or tab. The cable connector barrel 12 may include a tubular portion 17 receiving and suitably secured, as by crimping, to a cable 18, which extends into one end of the tube 17. The other end of the tube 17 is flattened, as at 20, or otherwise formed into a tab or extension for facing engagement with the cup tab or extension 16. The superposed tabs 16 and 20 may be suitably connected together, as by a rivet 21, to assure electrical continuity, and the rivet may be formed to define a pivotal connection between the cap and cable connector.

Considering the cap 11 now more in detail, it may be drawn from flat material to include an outer end wall or closure 25, say of generally circular configuration, from which extends a peripheral side wall or sleeve 26, generally normal to the end wall 25. The sleeve 26 may include an outer sleeve end portion 27 extending directly from and integrally connected to the end wall 25, and being of generally cylindrical configuration. Stated otherwise, the outer end portion 27 of sleeve 26 may have zero taper.

The sleeve 26 further includes an inner end portion 28 which extends longitudinally from the inner end of the outer end sleeve portion 27, integrally therewith, and diverges or flares in the inward direction, away from the cylindrical outer sleeve end portion 27. Thus, the inner sleeve end portion 28 defines the frustum of a cone, being generally coaxial with the cylindrical outer cap end portion 27. From the larger, inner end of the conical or flaring inner sleeve portion 28, radially thereabout, extends the flange or lip 15, lying generally in a plane normal to the axis of the sleeve.

Figure 2:
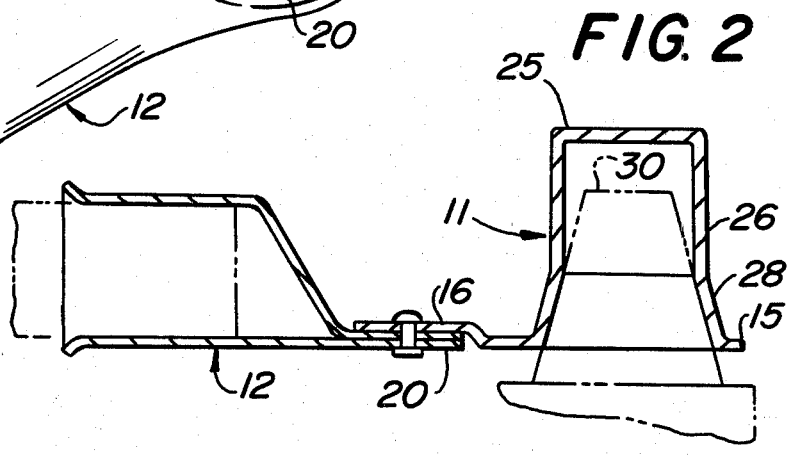
FIG. 2 is a longitudinal sectional view taken generally along the line 2—2 of FIG. 1, and adding in phantom a battery terminal post.

As best seen in FIG. 2, the flared inner end portion 28 of the sleeve 26 is in firm, snug frictional engagement with a received battery terminal post 30. This engagement may be effected by manually placing the cap 11 over the post 30 and twisting, as by grasping the barrel 12 and/or lip 15 and bearing downwardly while turning.

Figure 3:
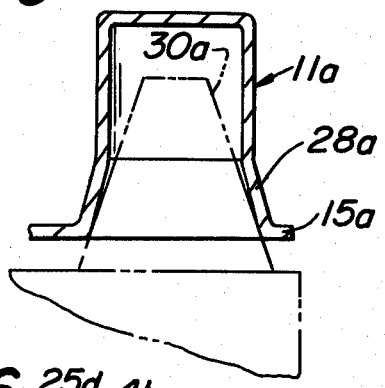
FIGS. 3 and 4 are sectional views similar to FIG. 2, but illustrating commercially varying tolerances of battery posts in operative relation to the connector cap of the instant invention.
Figure 4:
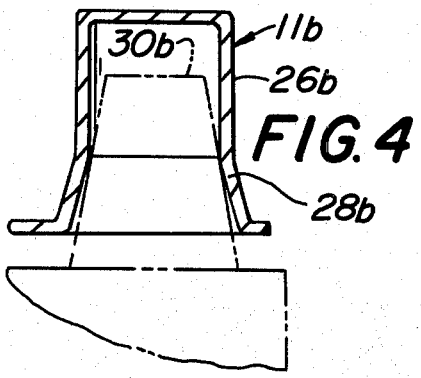

In FIGS. 3 and 4 are shown, in phantom, battery terminal posts **30*a* and 30*b*, respectively, which are of slightly different taper, which may be within commercial tolerances. In particular, battery terminal post 30*a* is of a greater taper and battery terminal post 30*b* is of a lesser taper. In applying cap 11*a* to post 30*a*, there is illustrated contact of the inner sleeve end portion 28*a* at the lip or flange 15*a*** with the battery terminal post.

In the embodiment of FIG. 4, the cap 11*b* makes contact with the battery terminal post 30*b* at the inner end of the outer sleeve end region 26*b*, where it joins with the outer end of the inner sleeve end region 28*b*. There is firm mechanical connection and intimate area engagement for electrical contact in both the extreme conditions of FIGS. 3 and 4, as well as all intermediate post taper conditions.

It is advantageous that the overall length of cap 11 approximate the height of a battery terminal post; and that the length of cylindrical or pilot, outer end region 26 be approximately $\frac{2}{3}$ overall length, while the length of the inner sleeve or flared end region 28 approximate $\frac{1}{3}$ the overall length. With a flared or inner end region 28 approximately $\frac{1}{3}$ the overall length, the outer end region 11 is of sufficiently small diameter to provide a convenient pilot for assembly through the eyes of tap-off lugs, as will appear presently. Also, with the flared inner end sleeve portion 28 sufficiently short, as noted above, a plurality of stacked tap-off lug eyes may be circumposed about the flared sleeve portion without excessive gap for effective securement, also appearing presently.

Figure 5:
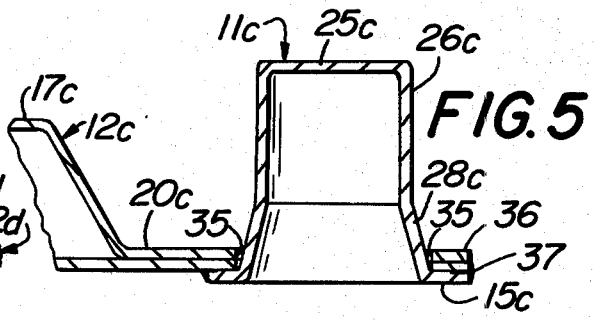
FIG. 5 is a longitudinal sectional view similar to FIG. 2, showing another embodiment of the invention.

In the embodiment shown in FIG. 5, a cap is generally designated 11*c* and may be substantially similar to the cap 11 of FIGS. 1 and 2. That is, the cap 11*c* includes a generally circular end wall or closure 25*c*, and outer sleeve end portion 26*c* extending integrally from the periphery of end wall 25*c*, and generally normal to the end wall in the configuration of a cylinder or tube having a taper of zero or less than the taper of a battery terminal post. Extending from the inner end of the outer sleeve end portion 26*c* is an inner sleeve end portion 28*c* which flares in the direction away from the outer sleeve end portion 26*c*, having a taper approximating that of a battery terminal post. Extending circumferentially about the larger end of the flared sleeve portion 28*c* is a peripheral lip, rim or flange 15*c*, which may be generally annular and without a tab or extension corresponding to the tab or extension of FIGS. 1 and 2.

The cable connector 12*c* of FIG. 5 may include a tubular barrel 17*c* having one end region flattened, as at 20*c*, and centrally apertured, as at 35 to define an open lug or eye 36. As seen in FIG. 5, the open lug or eye 36 is of two superposed layers and seated firmly on the annular flange 15*c*. Further, the internal diameter of the circular aperture 35 of lug 36 may be such as to form a snug or force fit circumposed about the inner sleeve end portion 28*c* when the lug is seated on the flange 15*c*.

In addition to the snug frictional fit of lug 36 about sleeve portion 28*c*, or as an alternative thereto, the apertured lug may be otherwise suitably secured to the rim or flange 15*c*, say by spot welding, as at 37.

Figure 6:
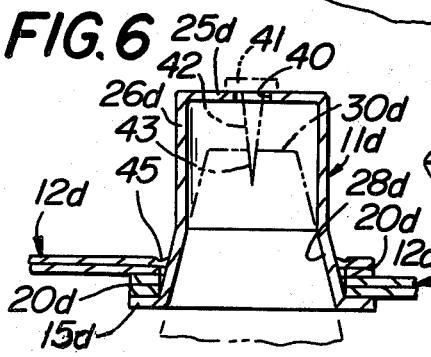
FIG. 6 is a longitudinal sectional view showing still a further embodiment of the instant invention.

In the embodiment shown in FIG. 6, there is a connector cap 11*d* essentially similar to the connector cap 11*c*, including an outer sleeve end portion 26*d* which may be generally cylindrical or of a taper less than that of a battery terminal post 30*d*. A flaring inner end sleeve portion 28*d* extends longitudinally inwardly from the inner end of sleeve portion 26*d* and is provided on its inner end with a generally annular circumferential flange 15*d*, all of which may be the same as the cap 11*c* of FIG. 5.

However, the cap 11*d* may include an outer end wall or closure 25*d* having a central opening, as at 40 for passing a fastener 41, such as a screw, or other suitable fastener into securing engagement with the post 30*d*. More specifically, the headed and threaded fastener 41 may engage through the outer end wall opening 40 with its threaded shank 42 entering into threaded engagement in a suitable hole 43 formed in the outer end of the terminal post 30*d*. With the shank 42 secured in the post 30*d*, the head 41 may engage the outer surface of the end wall 25*d*, to secure the cap 11*d* in firm electrical contacting circumposition about the post 30*d*. Also shown in FIG. 6 are a plurality of cable connectors having apertured end lugs 20*d* superposed in aligned relation with each other on the circumferential flange 15*d* and in snug, frictional or forced engagement about the flaring inner end sleeve portion 28*d*. While a pair of apertured lugs 20*d* are shown in FIG. 6 as frictionally circumposed about the inner sleeve end portion 28*d*, it is understood that three or more such cable connector lugs may also be frictionally engaged or force fit about the flaring inner sleeve end portion 28*d*.

If desired, the upper or outer face of the outermost lug 20*d* may be deformed inwardly into forced retaining engagement with the sleeve portion 28*d*. For example, by ring staking, a bead 45 may be formed on the inner margin of the aperture of the uppermost lug 20*d*, the bead engaging the sleeve portion 28 to retain the uppermost lug on the sleeve portion, and to retain any other lugs firmly clamped in position about the sleeve portion 28*d* between the outermost lug and the flange 15*d*.

From the foregoing, it is seen that the present invention provides a uniquely improved battery post terminal connector which is extremely simple in construction, economic in manufacturing steps and materials, durable and reliable throughout a long useful life, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A connector cap for a battery terminal post or the like, said cap comprising a circumferentially continuous tubular outer sleeve end portion having a longitudinal taper less than that of the battery terminal post, a circumferentially continuous tubular inner sleeve end portion extending longitudinally inwardly from said outer sleeve end portion and having a longitudinal taper greater than that of said outer sleeve end portion to flare longitudinally inwardly relative to said outer sleeve end portion, and a circumferentially continuous radial flange on the inner end of said inner sleeve end portion, said inner sleeve end portion being adapted for snug continuous circumposition about the battery terminal post in firm frictional engagement therewith.

2. A connector cap according to claim 1, said outer and inner sleeve end portions being integrally fabricated of conductive material.

3. A connector cap according to claim 1, said outer sleeve end portion being generally cylindrical for use as a pilot.

4. A connector cap according to claim 1, said flange extending smoothly from the larger end of said inner sleeve end portion for guiding engagement onto a battery terminal post.

5. A connector cap according to claim 4, in combination with a plurality of superposed apertured lug layers circumferentially engaged about said inner end portion with the innermost lug layer seated on said flange and and the outermost of said lug layers staked radially inwardly to form an annular bead in holding engagement with said inner end portion.

6. A connector cap according to claim 4, said inner sleeve end portion flaring with a taper approximating that of the battery terminal post for frictional engagement therewith about an annular area.

7. A connector cap according to claim 6, in combination with an end closure on the distal end of said outer end portion for protecting the area of frictional engagement with the battery terminal post.

8. A connector cap according to claim 6, said outer and inner end portions being coaxial and the length of said inner end portion being substantially less than that of said outer end portion while being sufficiently long to receive engaged thereabout a plurality of apertured connector lugs.

9. A connector cap according to claim 6, in combination with at least one apertured lug layer snugly engaged circumferentially about said inner end portion seated on said flange.

* * * * *